US010456638B2

(12) United States Patent
Dolezel et al.

(10) Patent No.: US 10,456,638 B2
(45) **Date of Patent: *Oct. 29, 2019**

(54) GOLF CLUB HEAD

(71) Applicant: DUNLOP SPORTS CO. LTD., Kobe-shi, Hyogo (JP)

(72) Inventors: Keith Dolezel, Covina, CA (US); Dan Nivanh, Tustin, CA (US); Mitch Samson, Minneapolis, MN (US); Joseph Chen, Costa Mesa, CA (US); Mika Becktor, Costa Mesa, CA (US); Michael Boyle, Newport Beach, CA (US); Dustin Brekke, Fountain Valley, CA (US); Bryce Weir, Santa Ana, CA (US); Phillip C. Seagram, Long Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/046,608

(22) Filed: Jul. 26, 2018

(65) Prior Publication Data

US 2018/0333620 A1 Nov. 22, 2018

Related U.S. Application Data

(63) Continuation of application No. 15/290,736, filed on Oct. 11, 2016, now Pat. No. 10,058,748, which is a (Continued)

(51) Int. Cl.

| | |
|---|---|
| ***A63B 53/00*** | (2015.01) |
| ***A63B 53/04*** | (2015.01) |
| ***A63B 60/52*** | (2015.01) |

(52) U.S. Cl.
CPC ..... *A63B 53/0487* (2013.01); *A63B 60/52* (2015.10); *A63B 2053/0408* (2013.01); (Continued)

(58) Field of Classification Search
CPC ... A63B 53/0487; A63B 53/00; A63B 53/007; A63B 53/04; A63B 2053/0462; (Continued)

(56) References Cited

U.S. PATENT DOCUMENTS 5,078,398 A 1/1992 Reed et al.
5,197,737 A * 3/1993 Desbiolles ..... A63B 53/0487 473/341

(Continued)

OTHER PUBLICATIONS

Nike Golf Method Converge M1-08 Putter. Information and images available at: <http://www.golfwrx.com/246795/full-nike-2015-equipment-line>, pp. 10-11. Oct. 1, 2014.

(Continued)

*Primary Examiner* — John E Simms, Jr.
(74) *Attorney, Agent, or Firm* — Oliff PLC

(57) ABSTRACT

A putter-type golf club head has a main body and a face component including a first element formed of a resilient material. The putter-type golf club head also has a second element forward of the first element and including a rigid material. The second element is secured directly to the first element. The first element has a thickness that gradually increases toward a sole portion of the club head.

18 Claims, 15 Drawing Sheets

Related U.S. Application Data continuation of application No. 14/806,041, filed on Jul. 22, 2015, now Pat. No. 9,474,948.

(60) Provisional application No. 62/077,520, filed on Nov. 10, 2014.

(52) U.S. Cl.
CPC ..... *A63B 2053/0425* (2013.01); *A63B 2053/0429* (2013.01); *A63B 2053/0433* (2013.01); *A63B 2053/0462* (2013.01)

(58) Field of Classification Search
CPC .... A63B 2053/0429; A63B 2053/0408; A63B 2053/0425; A63B 2053/0416; A63B 2053/042; A63B 2053/0458
See application file for complete search history.

(56) References Cited

U.S. PATENT DOCUMENTS 5,344,149 A * 9/1994 Miller ..... A63B 53/0487 473/340
5,405,136 A 4/1995 Hardman
5,464,212 A 11/1995 Cook
5,766,093 A 6/1998 Rohrer
5,785,608 A 7/1998 Collins
5,857,922 A * 1/1999 Delio ..... A63B 53/0487 473/313
5,921,871 A 7/1999 Fisher
5,944,619 A 8/1999 Cameron
6,200,229 B1 3/2001 Grace et al.
6,302,807 B1 10/2001 Rohrer
6,375,583 B1 4/2002 Solheim
6,680,822 B1 1/2004 Lin et al.
6,951,518 B2 10/2005 Solheim et al.
7,175,540 B2 2/2007 Sano
7,455,599 B2 11/2008 Jones
7,648,424 B2 1/2010 Hinojosa
8,771,098 B2 7/2014 Hilton
8,834,285 B2 9/2014 Franklin et al.
8,900,071 B2 12/2014 Kii
D730,462 S 5/2015 Becktor et al.
2004/0152538 A1* 8/2004 Bonneau ..... A63B 53/0487 473/340
2004/0173964 A1* 9/2004 Pollman ..... A63B 53/02 273/252
2005/0090328 A1* 4/2005 Sano ..... A63B 53/0487 473/340
2005/0164806 A1* 7/2005 Solheim ..... A63B 53/0487 473/342
2006/0094522 A1 5/2006 Tang et al.
2007/0099725 A1 5/2007 Tateno
2007/0155537 A1* 7/2007 Morris ..... A63B 53/0487 473/340
2007/0178987 A1* 8/2007 Wright ..... A63B 53/0487 473/329
2008/0020860 A1* 1/2008 Imamoto ..... A63B 53/047 473/332
2008/0153619 A1* 6/2008 Tucker ..... A63B 53/04 473/288
2009/0280925 A1* 11/2009 Ines ..... A63B 53/0487 473/340
2010/0222155 A1 9/2010 Jones et al.
2010/0317451 A1 12/2010 Stites et al.
2011/0065525 A1 3/2011 Johnson
2011/0319188 A1* 12/2011 Narita ..... A63B 53/0487 473/329
2012/0108357 A1 5/2012 Nakamura
2012/0149492 A1* 6/2012 Del Rosario ..... A63B 53/0487 473/340
2012/0184392 A1* 7/2012 Narita ..... A63B 53/0487 473/340
2013/0005503 A1 1/2013 Kii
2013/0137533 A1* 5/2013 Franklin ..... A63B 60/00 473/349
2014/0194220 A1 7/2014 Hocknell et al.
2015/0343285 A1 12/2015 Franklin et al.

OTHER PUBLICATIONS

Nike Method Converge B1-01 Putter. Information and images available at: <http://www.golfwrx.com/246795/full-nike-2015-equipment-line>. Oct. 1, 2014.
Nike Method Converge S1-12 Putter. Information and images available at: <http://www.golfwrx.com/246795/full-nike-2015-equipment-line>. Oct. 1, 2014.
Cobra Golf Payday putter. Information and images available at: <http://valueguide.pga.com/detail-exec/brand/2678/product_type/206/model/44329/b/Cobra/p/Putter/m/Payday%20Mallet>. Nov. 26, 2007.
Cobra Golf Bobby Grace Cute Kid Putter. Information and images available at: <https://valueguide.pga.com/detail-exec/brand/2678/product_type/206/model/43637/b/Cobra/p/Putter/m/Bobby%20Grace%20The%20Cute%20Kid>. Nov. 26, 2007.
Feb. 18, 2016 Office Action issued in U.S. Appl. No. 14/806,041.
Sep. 2, 2016 Office Action issued in U.S. Appl. No. 14/934,903.
Jan. 18, 2017 Office Action issued in U.S. Appl. No. 14/934,903.
Jun. 20, 2017 Office Action issued in U.S. Appl. No. 15/290,736.
Oct. 13, 2017 Office Action issued in U.S. Appl. No. 15/290,736.
Apr. 10, 2018 Office Action issued in U.S. Appl. No. 15/706,067.
Apr. 26, 2018 Notice of Allowance issued in U.S. Appl. No. 15/290,736.
Aug. 6, 2018 Office Action issued in U.S. Appl. No. 15/706,067.

* cited by examiner

GOLF CLUB HEAD

CROSS-REFERENCE TO RELATED APPLICATIONS

This application is a continuation of U.S. patent application Ser. No. 15/290,736, filed Oct. 11, 2016, which is a continuation-in-part of U.S. application Ser. No. 14/806,041, filed Jul. 22, 2015, which claims the benefit of U.S. Provisional Patent Application No. 62/077,520, filed Nov. 10, 2014, the subject matter of these applications is incorporated herein by reference in its entirety.

BACKGROUND

Putting is a critical aspect of success in the game of golf. Minor misjudgments in velocity and aim may spell the difference between success and failure. Slight misalignments in orientation may prove equally significant. Although the putting stroke is seemingly simplistic, minor deviations, e.g. in dynamic loft and/or height of the putter head at impact, from ideal conditions may have an outweighed effect on whether a putt is overshot, undershot, or just right. These variances are not well understood to the novice or recreational player and thus may lead to frustration and failure to progress. Thus, a need exists to counter the negative effects of minor misalignments of a putter-type golf club to reduce such frustration and promote engagement.

SUMMARY

In accordance with one or more embodiments, a putter-type golf club head is provided having a main body and a face component including a first element formed of a resilient material and a second element forward of the first element. The second element has a rigid material and is secured directly to the first element. The first element has a thickness that gradually increases toward a sole portion.

In accordance within one or more embodiments, a putter-type golf club head is provided having a main body having a front surface and a face component secured to the front surface of the main body. The face component includes a resilient body having a front surface, a rear surface opposite the front surface, a heel surface, and a toe surface. At least a portion of at least one of the heel surface and the toe surface is visually exposed. The resilient body defines a trapezoidal front-to-rear profile In accordance with one or more embodiments, a putter-type golf club head is provided comprising a striking face, a top surface, a rearward surface, a bottom surface having a beveled rear edge, a center of gravity having a depth, Dcg, and a club head depth Dch, such that Dcg/Dch is no less than 0.42.

The various exemplary aspects described above may be implemented individually or in various combinations.

These and other features and advantages of the golf club head according to the disclosure in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present disclosure, in one or more aspects thereof, is illustrated by way of example and not by way of limitation, in the figures of the accompanying drawings, where.

DETAILED DESCRIPTION

Figure 1:
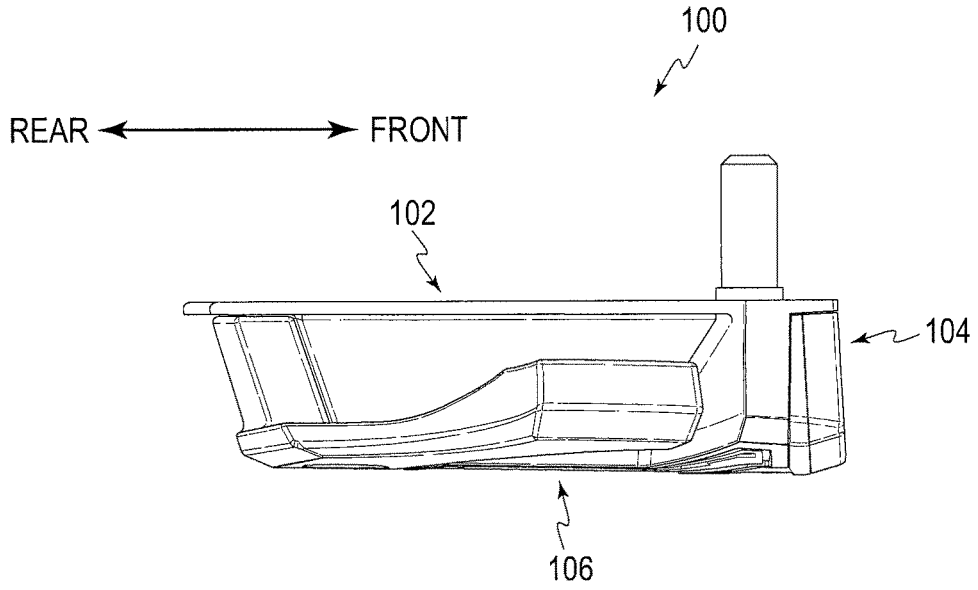
FIG. 1 is a toe-side elevation view of a golf club head, according to one embodiment.

As shown in FIGS. 1-8, in accordance with one embodiment, a putter-type golf club head 100 includes a body member 102, a face component 104, and a bottom portion 106. In some embodiments, the face component 104 is an aft-attached component affixed, preferably permanently, to the body member 102. Also, the bottom portion 106 may be aft-attached to the body member 102. This enables selectively positioning materials of different properties where they may be best suited.

The body member 102 may include a blade portion 108 (see FIG. 7) longitudinally extending in a heel-to-toe direction and a central elongate portion 110 extending rearward from the blade portion 108. The blade portion 108 and the central elongate portion 110, in combination, form a top surface 112, a bottom surface 114 (see e.g. FIG. 6), a rear surface 116 and a front surface 148.

For all purposes herein, the term "reference position" refers to an orientation of a club head relative to a virtual ground plane in which a sole portion of the club head rests on the virtual ground plane such that a hosel axis lies in a vertical hosel plane, and a horizontal line coincident with a striking face plane is parallel to the hosel plane.

For all purposes herein, the term "soled position" refers to an orientation of a club head relative to a virtual ground plane in which a bottom portion, or sole portion, of the club head contacts and freely rests on the virtual ground plane. Unless otherwise noted, all dimensions and positional characteristics described herein with regard to a golf club head are intended to be measured or determined with the golf club head oriented in a soled position.

The body member top surface 112 may further include an alignment element 120. The alignment element may include a shallow groove for assisting the golfer to alignment the putter with a golf ball. In some embodiments, the alignment element 120 may comprise a first and second geometric feature, e.g. squares 120(*a*) and 120(*b*). The top surface 112 further includes a recess (not shown) receiving an aft-attached hosel component 124.

As discussed above, and as particularly shown in FIG. 2, the face component 104 may include a first insert 126 comprising a compressible element and a second insert 128 comprising a cap element in communication with the first insert 126. Specifically, the second insert 128 is forward of the first insert 126 and may form a portion of the exterior striking face 130 of the club head 100.

Figure 2:
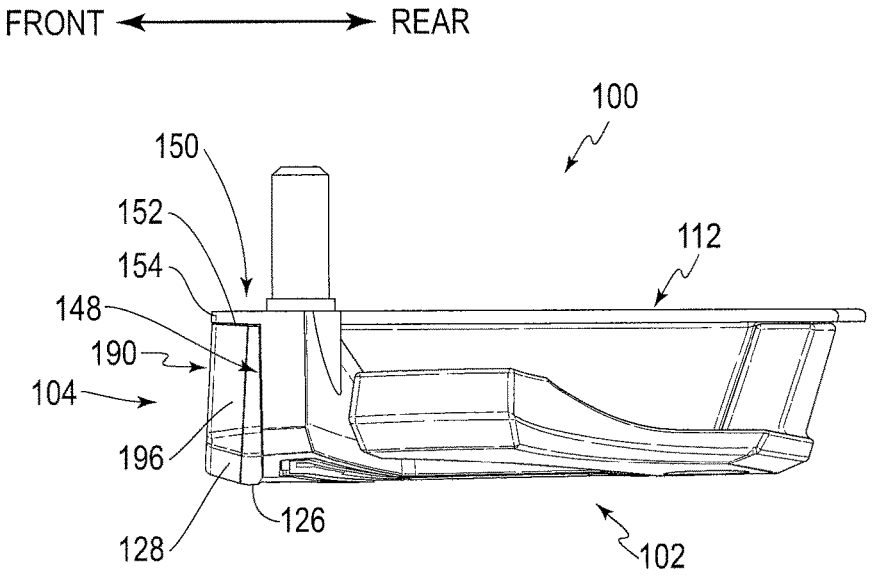
FIG. 2 is a heel-side elevation view of the golf club head of FIG. 1.

Referring to FIG. 2, the body member 102 includes a front portion including a near-vertical front surface 148. Preferably, the front surface 148 of the body member 102 forms a forward-leaning angle $\phi$ of 1° as projected in a vertical plane 170 perpendicular to the striking face 130 and relative to a vertical plane 172 perpendicular to the vertical plane 170 (see e.g. FIG. 13). A flange 150 projects forward from the front surface 148 (see e.g. FIG. 2). The flange 150 may further include a bottom surface 152, a front surface 154, which may form a portion of the striking face 130 of the club head 100, and a top surface that is preferably flush with and integral with the top surface 112 of the body member 102 of the club head 100. This configuration provides for removal of significant high density material from the front portion of the club head 100 and optional replacement with a lower density material, e.g. the face component 104. Specifically, the flange 150 ensures that the putter head 100 appears full-sized and continuous from a vertical position (i.e. the position of the golfer's eyes upon swinging a golf club including the embodied club head 100). Yet, the flange 150 provides a recessed region into which the face component 104 may be secured. Preferably, the front surface 148 of the body member 102 is a substantially planar surface. However, in some embodiments, some variation in contour is contemplated. For example, the surface may be roughened to provide improved adhesion with the face component 104. Alternatively, or in addition, the front surface 148 may include one or more projections and/or recesses adapted to mate with corresponding projections and/or recesses of the face component 104.

Figure 13:
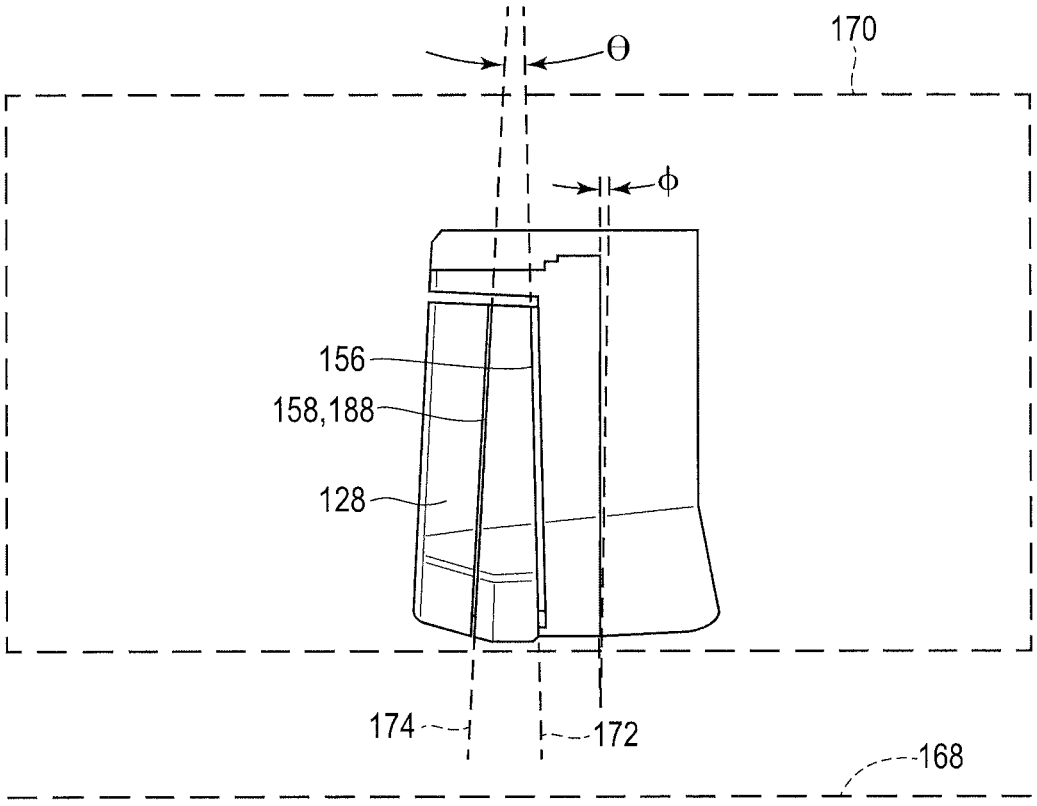
FIG. 13 is a heel side elevation view of a detail portion of the golf club head of FIG. 1.
Figure 14:
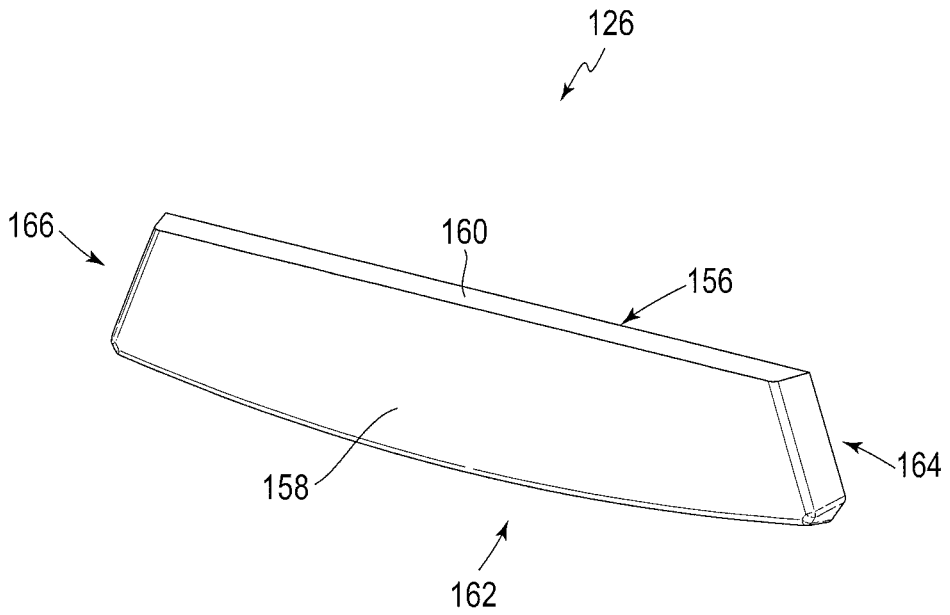
FIG. 14 is front perspective view of an insert component of the golf club head of FIG. 1.

The first insert 126, as described above, preferably constitutes a compressible element. Referring to FIGS. 13 and 14, the first insert 126 may comprise a rearward surface 156 and a forward surface 158 opposite the rearward surface 156. The first insert 126 further comprises a top surface 160, a bottom surface 162 opposite the top surface 160, a heel surface 164, and a toe surface 166 opposite the heel surface 164. The first insert 126 preferably comprises a resilient material, e.g. a polymeric material. Specifically, the first insert 126 is formed of a material having a hardness no greater than 60 Shore D, more preferably within the range of 30 Shore D to 50 Shore D, and even more preferably substantially equal to about 39 Shore D. In some embodiments, the first insert 126 comprises a thermoplastic urethane. Providing a compression element (i.e. the first insert 126) having such characteristics results in improved tactile rebounding characteristics upon impact. An insert having these properties may likely be a noticeably softer putter than what a golfer may typically be used to and may even be considered soft to the touch, further communicating the intended behavior of the putter face component 104.

The rearward surface 156 of the first insert 126 may contact the front surface 148 of the body member 102 (see e.g. FIG. 2). Preferably, the first insert 126 is coupled to the body member 102 e.g. by chemical adhesion of the rearward surface 156 with the front surface 148 of the body member 102. Further, preferably at least one of the heel surface 164 and the toe surface 166 is visually exposed and, more preferably, physically exposed. In other words, the front surface 148 of the body member 102 is preferably continuously planar entirely from a central portion outward toward at least one of the heel, toe, and bottom portion. More preferably, the front surface 148 is continuously planar from a central portion toward each of the heel, toe, and sole portions. Exposing the first insert 126 and/or the second insert 128 on at least one of the heel surface 164 and the toe surface 166 communicates to a golfer the tactile response behavior intended by the club head 100. Such exposure may also provide additional alignment features to ensure proper orientation during a putting stroke. For these reasons, the first insert 126 preferably exhibits a white, or whitish, color. This characteristic further provides a clear contrast from the color and/or texture of the second insert 128, which is preferably of a dark, black, and/or copper color. This contrast further draws attention to the first insert 126 and more particularly its front-to-rear shape, as will be described further below.

As shown in FIG. 13, the first insert 126 preferably comprises a trapezoidal profile in the front-to-rear direction. Particularly, the rearward surface 156 of the first insert 126 generally corresponds to a vertical planar surface (with the club head 100 in the soled position). The forward surface 158 of the first insert 126 is preferably angled relative to the vertical plane 172. The shaping of the compression layer in this manner is believed to apply static loft to the putter. Particularly, a plane 174 coincident with (or generally parallel with) the forward surface 158 of the first insert 126 forms an angle $\theta$ with the vertical plane 172. Preferably, the angle $\theta$ is no less than 1°, more preferably between 2° and 6°, and even more preferably substantially equal to about 4°. Because of the forward-leaning angle $\phi$ of 1°, the forward surface when secured to the body member 102 in an operable state exhibits a static loft angle of preferably between 1-4°, and more preferably about 3°. Such construction improves the castability of surfaces of the body member 102, particular in a die cast environment. However, other angular combinations are contemplated, particularly if the body member is formed by other means, e.g. machined. For example, if the front surface 148 of the body member 102 is intended to be milled, a draft angle $\phi$ of 0° may be more suitable. Also, exposing the first insert 126, bearing its trapezoidal profile, indicates a high-thickness sole portion of a resilient material, thereby communicating high resiliency, which is believed to be a factor affecting performance.

By forming the first insert in this manner, e.g. of a resilient material with thickness gradually increasing toward the bottom surface 162, overall performance is believed to be improved. For example, consider a case in which the putter head 100 impacts a golf ball with sufficient force to substantially fully compress the first insert 126. A ball struck low on the face will likely leave the putter face at a lower launch angle than a ball struck high on the face due to operation of the aforementioned first insert geometry. This is advantageous for at least for the following reason: when contact is made high on the face, it may typically be caused by forward pressed hands, in which case the loft of the putter would be artificially decreased and the resulting launch angle may be less than optimal. When contact is conventionally made low on the face 130, it may be because the user's hands have "broken" or allowed the putter head to contact the ball when in-front of the hands and thereby be dynamically lofted. Added loft may lead to a launch angle that is higher than optimal. The above-described first insert 126 geometry may act to overcome such natural tendencies. In effect, such structural formations decrease a golfer's shot dispersion, particularly in terms of dispersion of roll distance.

The first insert 126 further comprises a flange 176 projecting from a bottom portion. Particularly the flange 176 extends rearward continuously and integrally with the bottom surface 162 of the first insert 126. The flange 176 may be secured to the bottom surface 114 of the body member 102 and may, thus, form a portion of the bottom, or sole, surface of the club head 100. The flange 176 may be advantageous in providing increased surface area for forming an adhesive bond in securing the first insert 126 to the front surface 148 of the body member 102. In some embodiments, an adhesive material is applied between the first insert 126 and the front surface 148 of the body member 102. In some such embodiments, the adhesive is of the form of a two-sided tape, optionally having visco-elastic properties. Preferably, an adhesive tape layer is applied to a top surface 178 of the flange 176 has a surface area no less than 200 $mm^2$, more preferably no less than 300 $mm^2$, even more preferably no less than 325 $mm^2$ and most preferably equal to about 350 $mm^2$. Such an adhesive tape preferably has a thickness no less than 0.2 mm and preferably no greater than 1.0 mm, more preferably between 0.2 mm and 0.6 mm, and even more preferably equal to about 0.4 mm.

Because of the optional forward-leaning angle $\phi$ of 1°, the angle formed between the rearward surface 156 of the first insert 126 and the top surface 178 of the flange 176 (as projected into a vertical plane perpendicular to the striking face 130) may equal 89°. However, in some embodiments, the bottom surface 114 of the body member includes a sole draft of about 1°. Thus, in such cases, such angle formed between the top surface 178 of the flange 176 and the rearward surface 156 of the first insert 126 is equal to about 90°. In any case, the surfaces of the first insert 126 intended to be chemically bonded to the body member 102 are preferably well-mated, thus minimizing the risk of poor adhesion.

Figure 6:
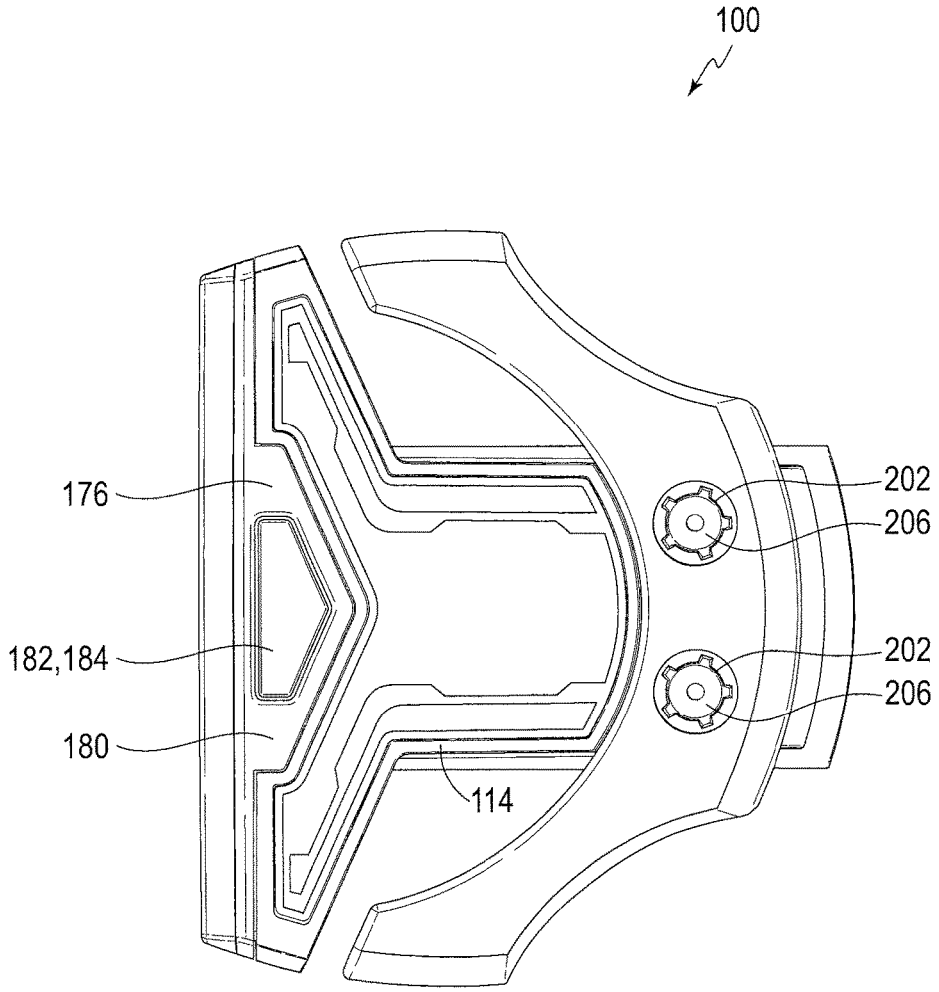
FIG. 6 is a bottom plan view of the golf club head of FIG. 1.
Figure 7:
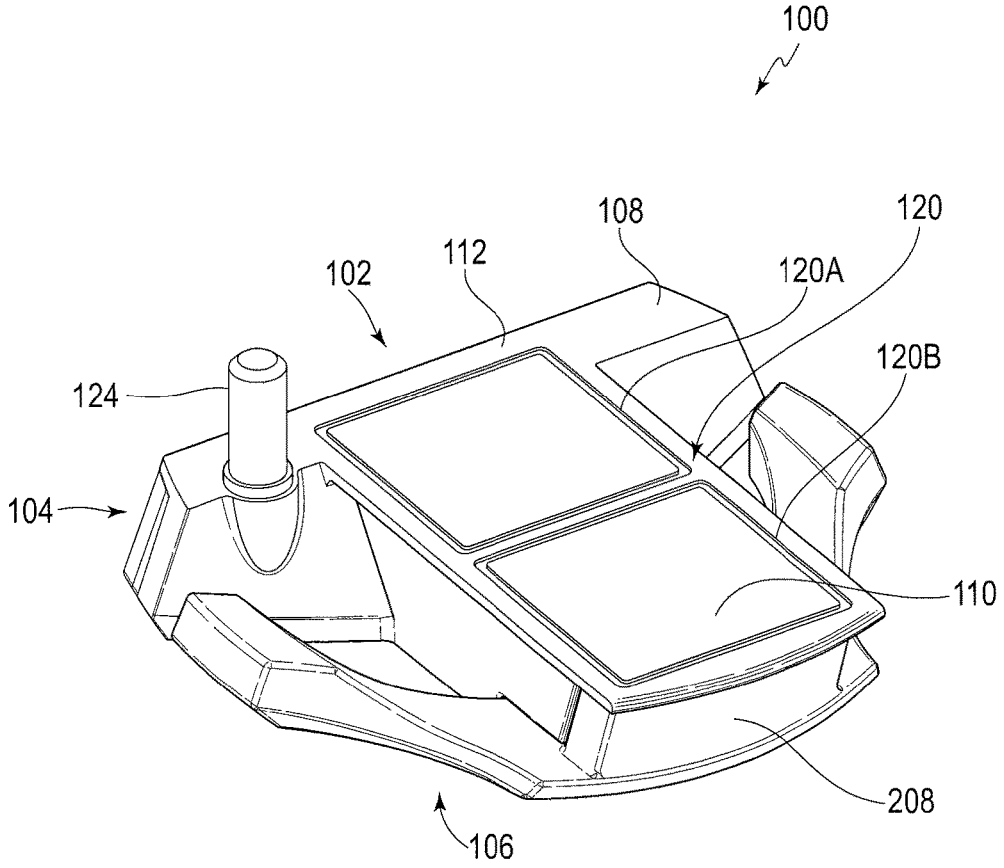
FIG. 7 is a rear perspective view of the golf club head of FIG. 1.
Figure 8:
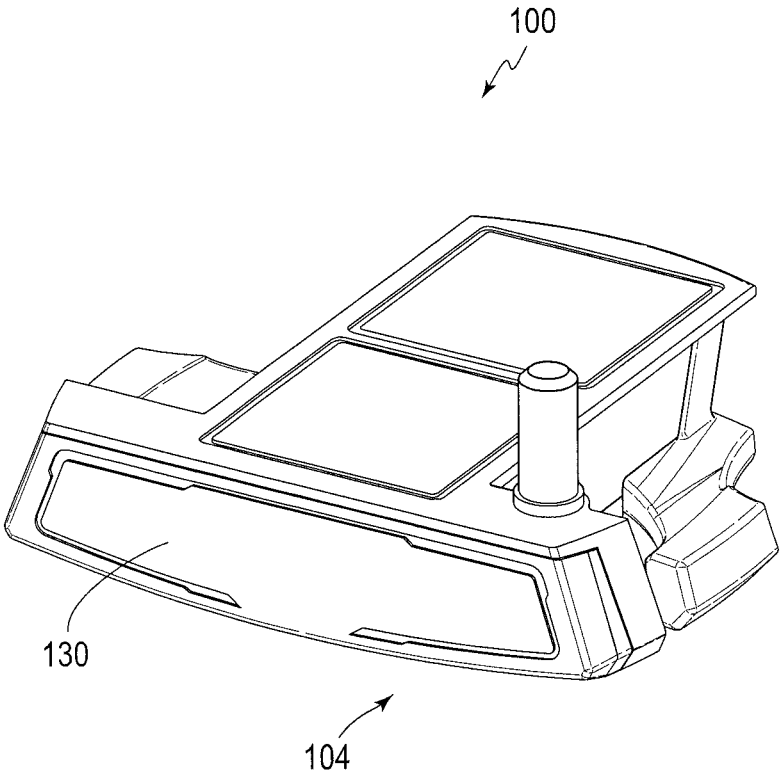
FIG. 8 is a front perspective view of the golf club head of FIG. 1.
Figure 15:
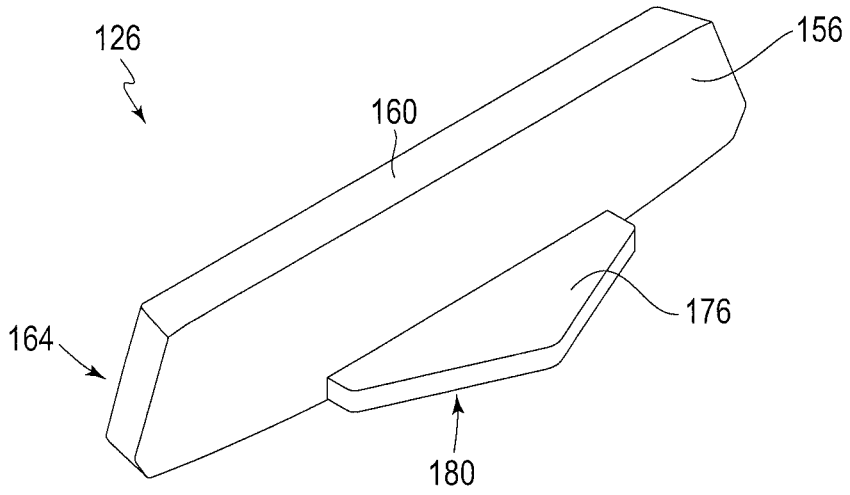
FIG. 15 is a rear perspective view of the insert component of FIG. 14.
Figure 16:
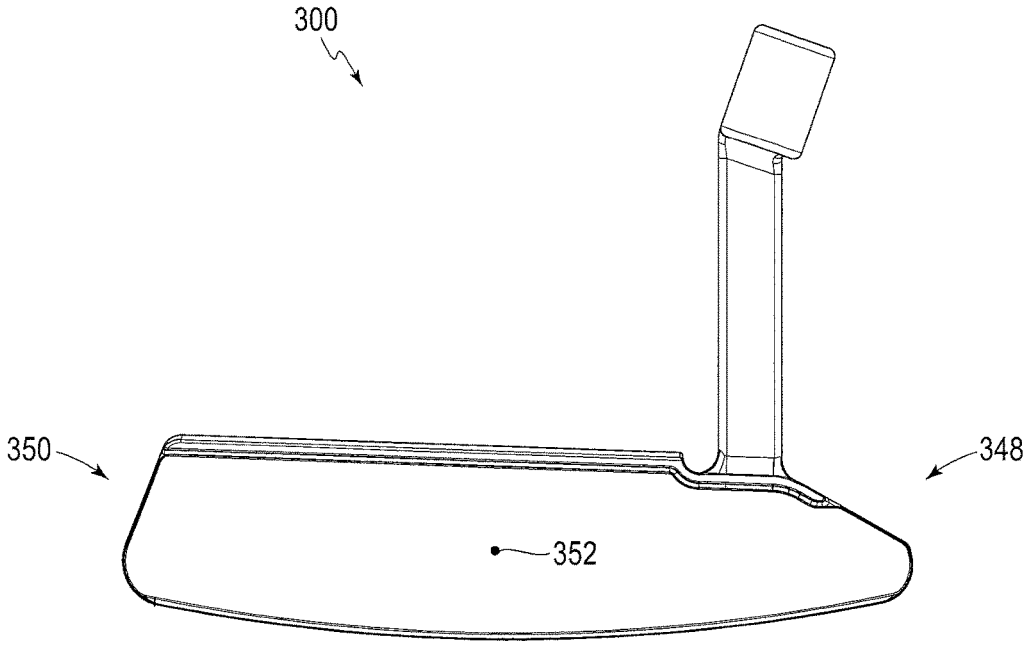
FIG. 16 is a front elevation view of a golf club head in accordance with one or more embodiments.
Figure 17:
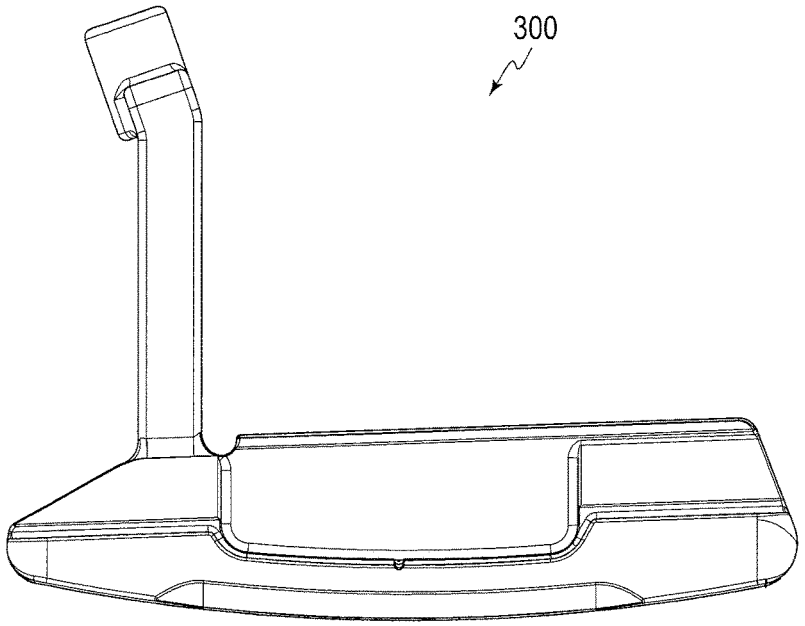
FIG. 17 is a rear elevation view of the golf club head of FIG. 16.
Figure 18:
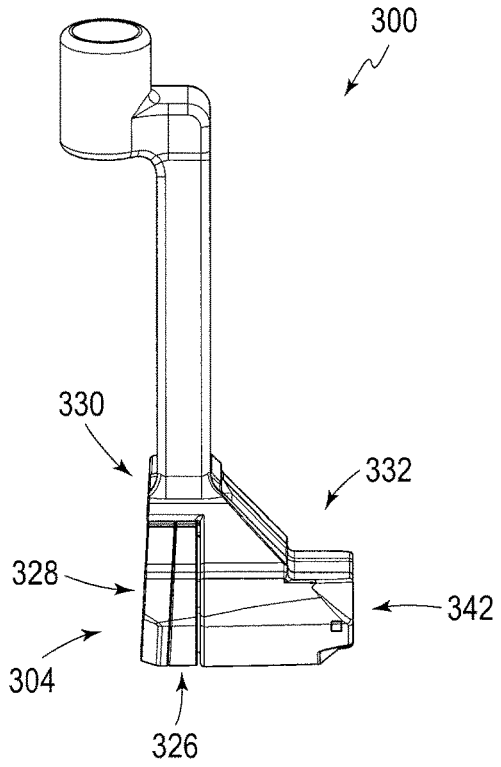
FIG. 18 is a heel-side elevation view of the golf club head of FIG. 16.

Referring to FIGS. 6 and 15, in some embodiment, the flange 176 further comprises a bottom surface 180 that may include a recess 182. The recess 182 may be at least partially filled, e.g. with an insert 184 being a plaque or medallion. Indicia may be positioned on the external surface of the plaque 184. Preferably the recess 182 has a depth of no less than 0.75 mm, more preferably no greater than 2.0 mm, even more preferably between 1.00 mm and 1.50 mm, and yet more preferably equal to about 1.33 mm. An adhesive two-sided tape may also be sandwiched between the plaque 184 and bottom surface 180 of the flange 176 to secure the plaque 184 to the flange 176. The tape preferably bears structural dimensions as discussed above with regard to adhesion of the first insert 126 with the body member 102.

The second insert 128 may comprise a cap element and at least partially cover the forward surface 158 of the first insert 126. Preferably the second insert 128 is of a material that is less resilient that the first insert 126 and/or preferably harder than the material of the first insert 126. In some embodiments, the second insert 128 comprises aluminum or an aluminum alloy. Aluminum, as opposed to denser conventional metals, enables the relocation of more significant mass from the front portion of the club head to more desirable locations e.g. the rear and outer portions for increasing the moment of inertia of the club head 100, and thus providing for a more forgiving club head.

Preferably the second insert is forged and comprises a thickness of between 2 mm and 6 mm, more preferably between 3 mm and 5 mm, and even more preferably equal to about 3.6 mm. However, other forms of manufacture are contemplated, for example machining, milling, and stamping. Because of this desired thickness, however, forging may be a more desirable form of manufacture than stamping. In some embodiments, additional surface processing and/or machining operations are applied. For example, a fly cutter may be applied the surface of the second insert to ensure thicknesses are within intended tolerances. Exemplary fly cutter operational parameters include a feed rate of between 20 and 25 mm/s, and a cutter rotational speed of between 7,000 and 9,000 rpm, more preferably equal to about 8,000 rpm.

Figure 11:
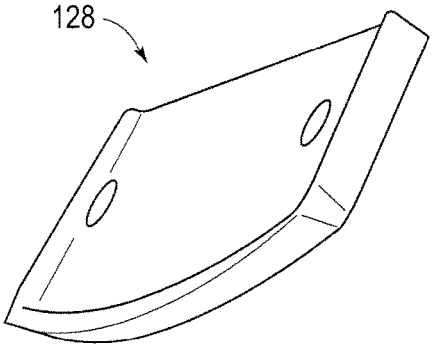
FIG. 11 is a perspective view of an insert component of the golf club head of FIG. 1.
Figure 12:
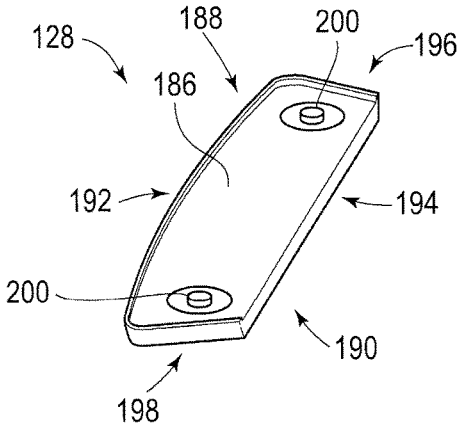
FIG. 12 is a perspective view of the insert component of FIG. 11.

Referring to FIGS. 2, 11 and 12, the second insert 128 may further include a rear surface 188, a front surface 190 opposite the rear surface 188, a top surface 192, a bottom surface 194, a heel surface 196, and a toe surface 198. The front surface 190 may form a portion of the striking face 130 of the club head 100 and, more preferably, the majority of the striking face 130. In some embodiments, the striking face 130 consists entirely of the front surface 190 of the second insert 128 and the front surface of the flange 150 of the body member 102.

The rear surface 188 preferably includes a recess 186. Preferably, a peripheral wall is formed around the entire periphery of the recess 186. However, in some embodiments, the recess 186 may be at least partially open, outwardly from a central location. In some embodiments, an adhesive material is located within the recess 186 and adapted to secure the second insert 128 to the first insert 126. In some such embodiments, the adhesive material comprises a two-sided adhesive tape bearing structural characteristics as described above with regard to the two-sided tape optionally located between the first insert 126 and the front surface 148 of the body member 102.

In some optional embodiments, one or more locator projections 200 and/or recesses are associated with the rear surface 188 of the second insert 128 that correspond to and are adapted to mate with corresponding recesses and/or projections of the forward surface 158 of the first insert 126. However, such features are not required and may in fact deleteriously result in the presence of air pockets between the respective surfaces of the two inserts.

Based on a preferred depth of the face component 104 relative to a forwardmost extent of the body member 102, a positive-type hosel is preferable. Such a configuration renders moot the requirement of a large bore extending from the top surface 112 of the body member 102. The blade portion 108 may need to be thickened (i.e. increased in width) to accommodate the large bore. Such thickening may negatively affect the distribution of mass of the club head. At a minimum, such thickening may require the use of structural mass, thereby reducing mass available specifically for purposes of performance enhancement (i.e. "discretionary mass"). Also, the presence of a large bore in close proximity to the face component 104 may cause deficit in structural integrity (e.g. by resulting in too thin of a wall between the face component 104 and the hosel bore). However, in some embodiments, an internal bore extends from the top surface 112 for receiving a shaft or shaft adapter.

In some embodiments, a positive-type hosel is integrally formed with the body member 102, e.g. a cast-in element. However, as discussed above, the putter head 100 is preferably formed by die casting. Accordingly, a cast-in positive-type hosel may likely require a chamfered surface, e.g. of about 1.5°. Such structures however have been identified as potentially resulting in poor consistency in assembly. Also, casting-in an element requiring an added height of, e.g., 20 mm may lead to increased manufacturing costs, particularly in a die cast environment.

Additionally, as discussed above, forming club head elements of separate components permits customizing materials to the particular functions of the structure of which they constitute. For example, in some cases, it may be desirable for a putter head, such as putter head 100, to include a hosel having bendable properties such that adjustment may be applied to the shaft position (e.g. a change in lie angle or a change in loft angle). Yet, as described in above embodiments, it may be desirable to form a putter head by die casting. Materials suitable for die casting purposes may differ from materials capable of providing bendability (e.g. in a hosel component of a club head). Accordingly, the inventors have recognized that greater acceptance may be realized by forming a club head main body of a material suitable for die casting, and structurally suited for a main body, while a different material may be incorporated into a hosel portion, e.g. in the manner of a separate aft-attached hosel component 124. Preferably, the body member 102 is formed of aluminum alloy. However, other materials are also possible. In this case, aluminum may not be a material of sufficient strength to withstand the degree of moment applied by a bending bar in providing such an adjustment. Thus, in such embodiments (i.e. when the body member is formed of aluminum or an aluminum-alloy), the separately-attached hosel component 124 is preferably formed of a milled steel. Of course, other materials are possible, particularly those of relatively high strength.

The top surface 112 of the body member 102 thus includes a recess 122 preferably forming a bore of generally circular cross-section. At least in part for the reasons described above, the recess 122 preferably has a diameter less than the diameter of a tip of a conventional shaft. More preferably the diameter of the recess 122 is no greater than 8 mm and more preferably equal to about 6 mm.

Figure 9:
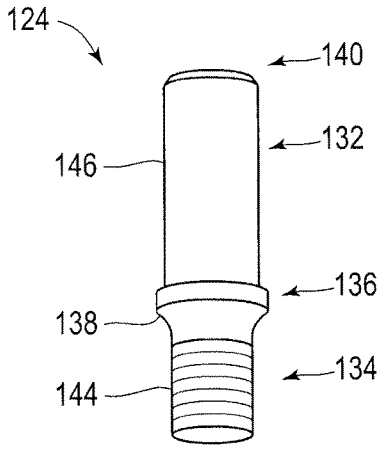
FIG. 9 is a perspective view of a hosel component of the golf club head of FIG. 1.
Figure 10:
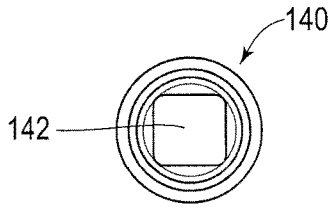
FIG. 10 is a bottom plan view of the hosel component of FIG. 9.

In some embodiments, referring to FIGS. 9 and 10, the hosel component 124 includes a top portion 132 and bottom portion 134. An annular ridge 136 may be located intermediate the top portion 132 and the bottom portion 134. The annular ridge may provide a bearing surface for the top surface 112 of the body member 102 in joining the hosel component 124 with the body member 102. A fillet 138 may be located between the annular ridge 136 and the bottom portion 134. Such fillet may reduce stresses common during the performance of the club head, as well as during a hosel adjustment process using a conventional bending bar. Bearing such applications in mind, the fillet is preferably of a radius no less than 1 mm, more preferably no less than 1.5 mm, and even more preferably substantially equal to about 1.9 mm.

Referring again to FIGS. 9 and 10, the bottom portion 134 may include a threaded portion 144. Similarly, the recess 122 preferably includes a corresponding threaded surface (not shown) for rotatable engagement with the threaded surface 144 of the bottom portion 134 of the hosel component 124. The top portion 132 may further comprise a generally cylindrical side surface 146 and a top surface 140. The top surface 140 preferably includes a tool socket 142 for operatively receiving a portion of a fastening tool. Such a tool may comprise a conventional screw driver, wrench, allen wrench, allen key, torx wrench, a wrench having a polygonal cross-section (e.g. square), a wrench having a proprietary cross-sectional shape, or the like. In one or more aspects of the present invention, the fastening tool includes a torque-sensing device and, optionally, an indicator for indicating, to the user, the current torque being applied to the fastener and/or when a threshold torque has been reached or exceeded. By enabling the use of a torque wrench, assemblers may ensure that appropriate torque is consistently applied.

In addition (or alternatively) to mechanically attaching the hosel component 124 to the body member 102, an epoxy or other chemical adhesive may be applied between the hosel component 124 and the body member 102. Alternatively, the hosel component 124 may be attached to the body member 102 by other mechanical means, such as press-fit or bolting, or alternatively, welding, brazing, or other attachment means suitable for such application. Preferably, an epoxy is used to couple a shaft (not shown) to the side surface 146 of the top portion 132 of the hosel component 124. The annular ridge 136 may also provide a bearing surface upon which a tip end of the shaft may be affixed to provide axial securement and ensure consistent location of the shaft from club head to club head during the assembly process.

In some embodiments, a flange on the trapezoidal shape side of the compression layer, which also continues across the bottom surface of the compression layer, may also partially fill the gap between the face cap (second insert 128) trailing edge and main body (body element 102) leading edge. The flange may fill the gap sufficiently to effect a purposefully "clean" and well-fitting look, but not so much as to cause fit interference as the thickness of the face cap, compression layer and main body face pocket vary according to manufacturing tolerances.

In some embodiments, the bottom portion 106 constitutes a separate body component. In some embodiments, the bottom portion 106 is adapted to be removable. For example, the bottom portion 106 may be secured to the body element 102 with mechanical fasteners such as one or more screws. The screws may include a threaded shaft portion and a head portion having a top surface 204. The top surface 204 may include a tool socket 206 for operatively receiving a portion of a fastening tool. Such a tool may comprise a conventional screw driver, wrench, allen wrench, allen key, torx wrench, a wrench having a polygonal cross-section (e.g. square), a wrench having a proprietary cross-sectional shape, or the like. In one or more aspects of the present invention, the fastening tool includes a torque-sensing device and, optionally, an indicator for indicating, to the user, the current torque being applied to the fastener and/or when a threshold torque has been reached or exceeded. By enabling the use of a torque wrench, assemblers may ensure that appropriate torque is consistently applied. In some embodiments, an adhesive, such as epoxy, is applied to the threaded shaft to result in permanent or semi-permanent securement. One or more resilient elements such as O-rings or gaskets may located within recesses in the body element 102 and between the body element 102 and the fasteners 202. Such resilient members may ensure a snug fit and prevent loosening during use due in part to vibrations emanating throughout the various components of the club head 100.

The bottom portion is preferably formed of a material having a density greater than the density of the main body. Particularly, the main body is preferably formed of a material having a density within the range of 1 g/cm$^3$ to 6 g/cm$^3$, more preferably between 2 g/cm$^3$ and 4 g/cm$^3$. The bottom portion 106 preferably has a density greater than 4 g/cm$^3$, and more preferably within the range of 6 g/cm$^3$ and 10 g/cm$^3$. Preferably the bottom portion 106 comprises zinc or a zinc alloy. The bottom portion includes a central mass element 208, a heel arm 210 projecting from a heel side of the central mass element 208, and a toe arm 212 projecting from a toe side of the central mass element 208.

Figure 3:
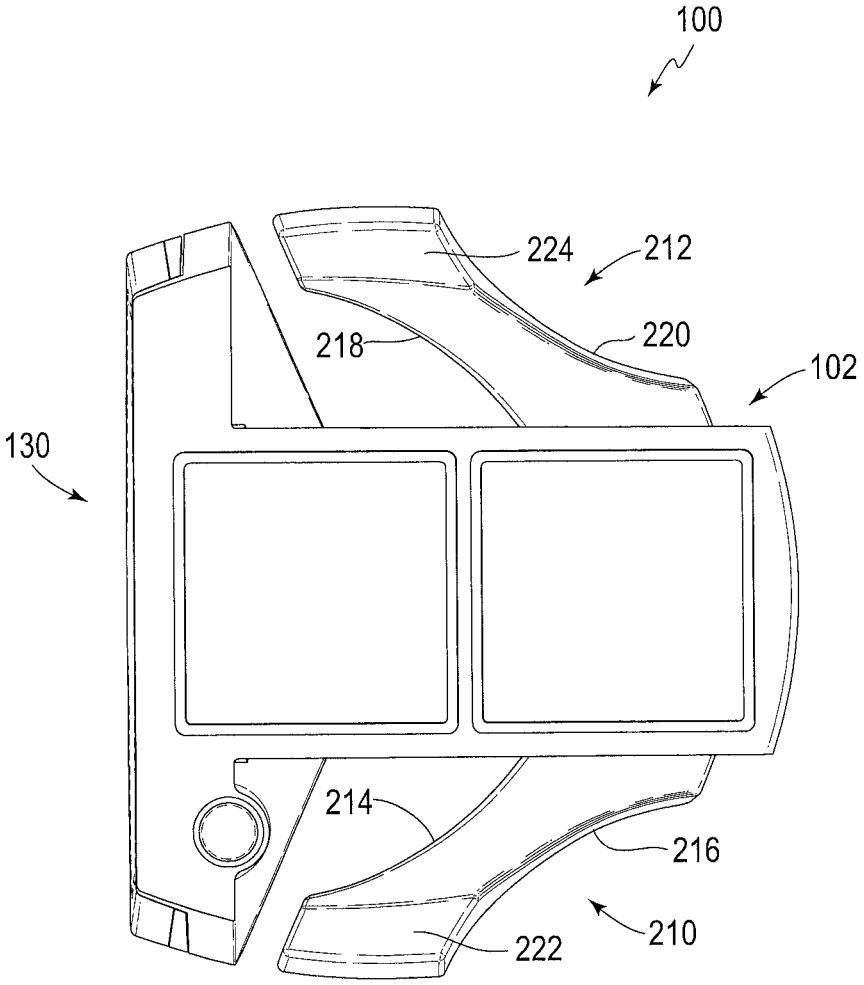
FIG. 3 is a top plan view of the golf club head of FIG. 1.
Figure 4:
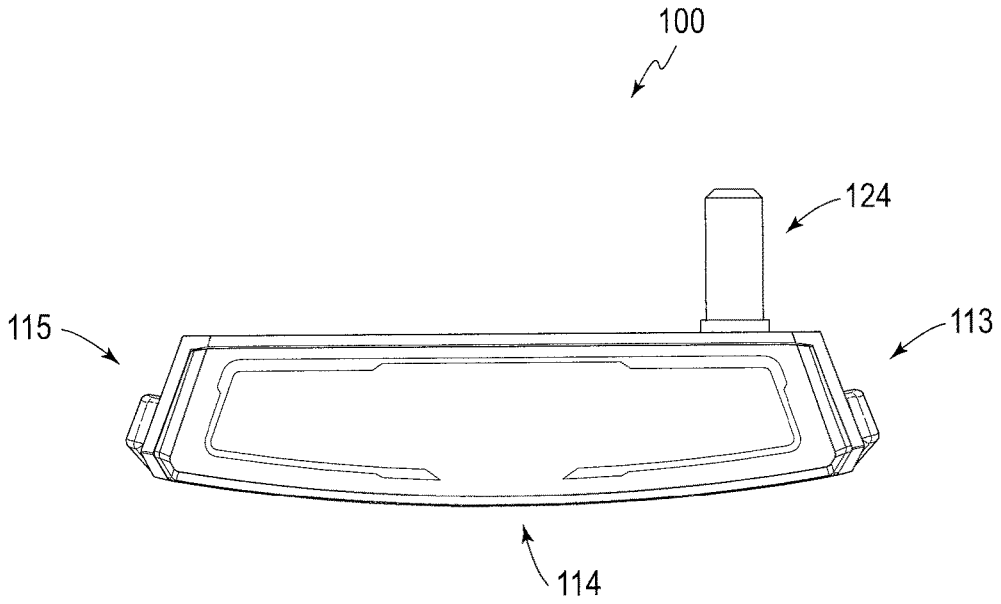
FIG. 4 is a front elevation view of the golf club head of FIG. 1.
Figure 5:
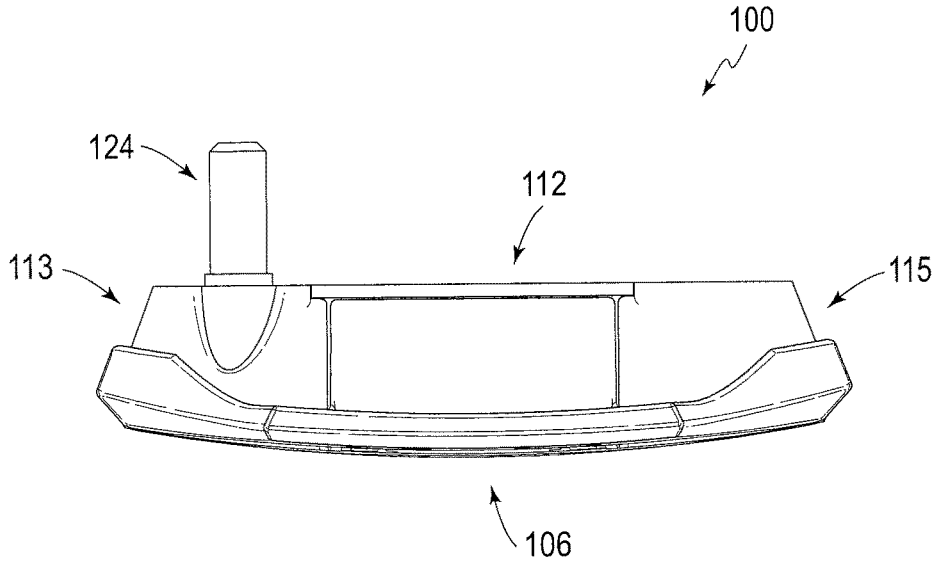
FIG. 5 is a rear elevation view of the golf club head of FIG. 1.

The heel arm 210 preferably extends outwardly and forwardly of the central mass element 208, as may be shown in top plan view (see e.g. FIG. 3). Similarly, the toe arm 212 preferably extends outwardly and forwardly of the central mass element 208, and optionally in symmetrical manner with respect to the heel arm 210 about a vertical plane passing through a geometric center of the striking face 130 of the club head 100 and perpendicular to the general plane of the striking face 130 of the club head when the club head 100 is oriented in a soled position. Both the heel arm 210 and toe arm 212 preferably each include an elongate portion optionally having one or more concave side portions 214, 216, 218, and 220 (as may be viewed in top plan view). Each of the heel arm 210 and the toe arm 212 further preferably terminate forwardly in a forward mass element (e.g. mass elements 222 and 224). The bottom portion 106 may be formed by die casting.

In one or more embodiments, referring to FIGS. 16-23, a putter-type club head 300 includes a body element 302 and a face component 304. The face component 304 may include a first element 326 and a second element 328 having characteristics similar to those described with respect to the embodiment shown in FIG. 1 and as described above.

The body element 302 includes a blade portion 330 and a rear portion 332 that, in combination, form a sole (bottom) surface 334, a top surface 336 including a top line 338, a rear top surface portion 340, a rearward surface 342, and a front surface 344. A hosel 346 may project upward from the top line portion 338. In some embodiments, the hosel 346 extends from a heel portion 348. However, extension from a toe portion, a central portion, or a rearward portion are also options. Further, the hosel 346 may be substituted for an internal bore extending inward from the top surface 336 of the putter head 300.

Figure 19:
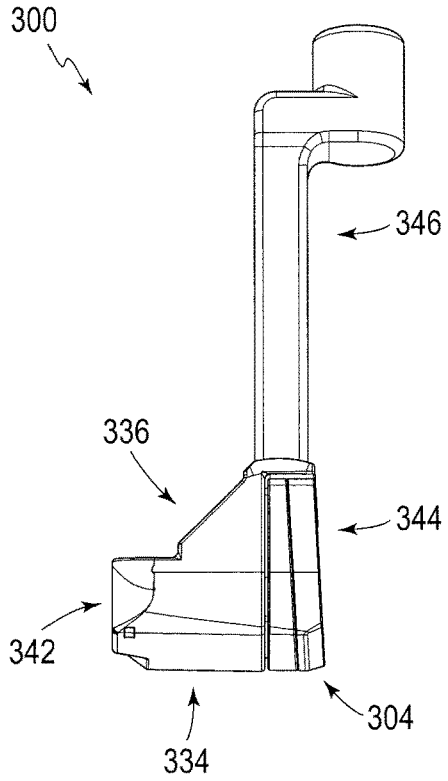
FIG. 19 is a toe-side elevation view of the golf club head of FIG. 16.
Figure 20:
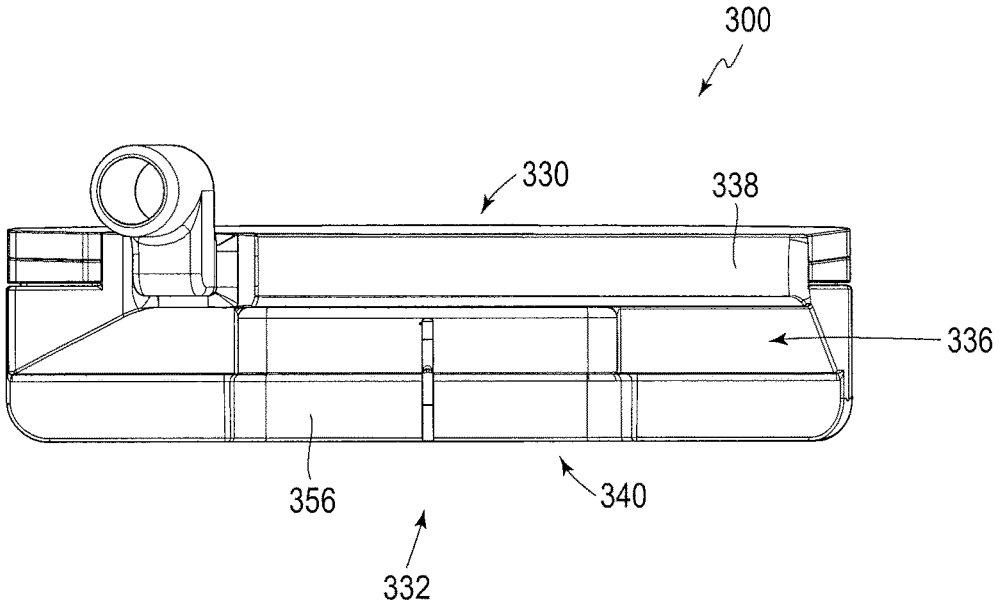
FIG. 20 is a top plan view of the golf club head of FIG. 16.
Figure 21:
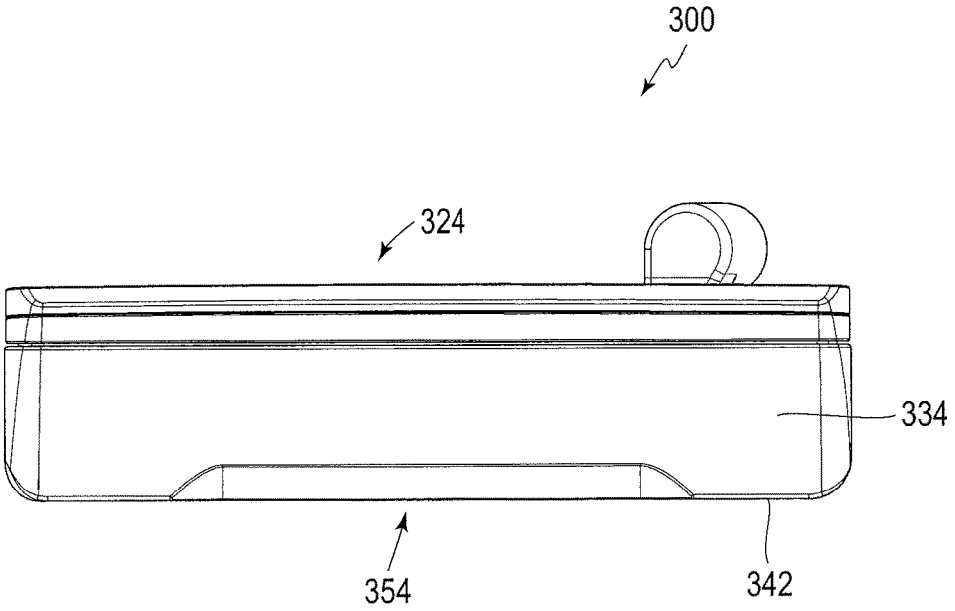
FIG. 21 is a bottom plan view of the golf club head of FIG. 16.
Figure 22:
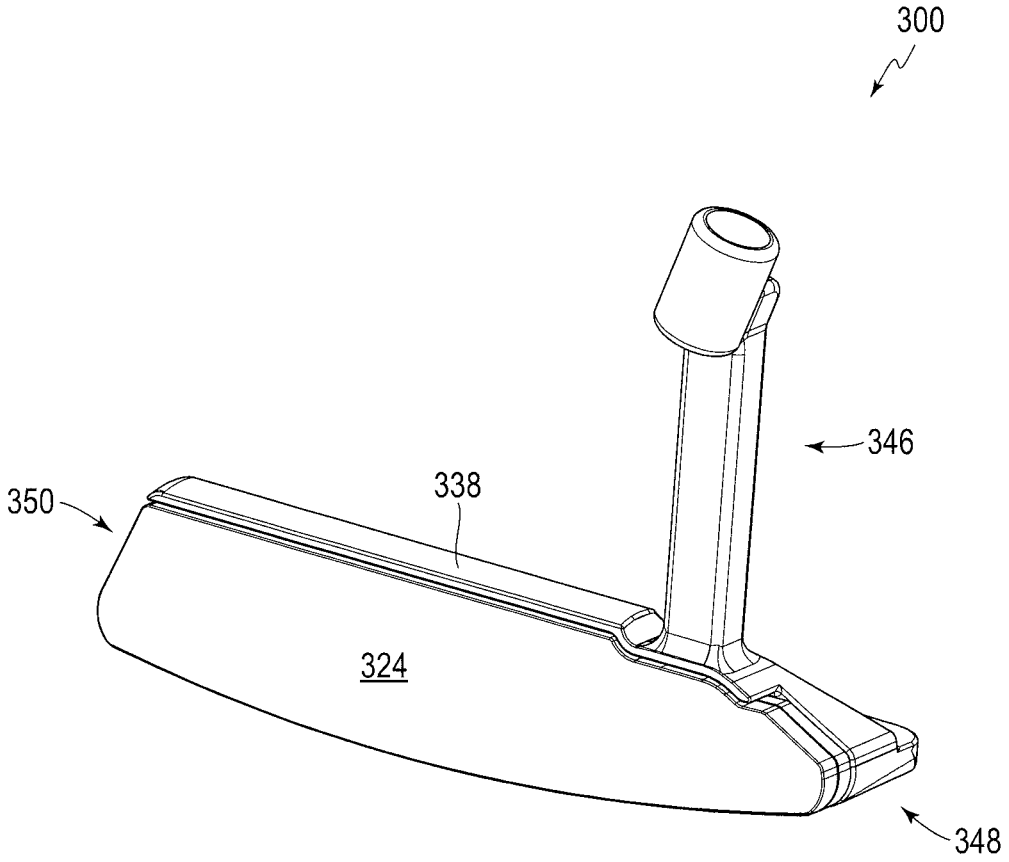
FIG. 22 is a front perspective view of the golf club head of FIG. 16.

In the particular embodiment shown in FIGS. 19 and 20, a face component 304 similar to the face component 104 of the embodiment of FIG. 1 is incorporated into a blade-shaped putter head 300. Such incorporation may be beneficial in providing the advantages associated with such a face component in a blade type putter, yet having advantages and desirable characteristics particularly suited for some golfers. However, as described above, the incorporation of such a face component 304 may result in necessary removal of a significant quantity of mass. In the case of a mallet-style putter, as in the embodiment of FIG. 1, such mass may appropriately, if not advantageously, be relocated to other regions of the putter head 100 without detraction. However, in the case of a blade-type putter head 300, the inventors believe relocation of the mass in a lesser-dimensioned space may detract from features typically sought after in a blade-type putter, e.g. accentuated heel and toe weights and a thin rear portion.

Figure 23:
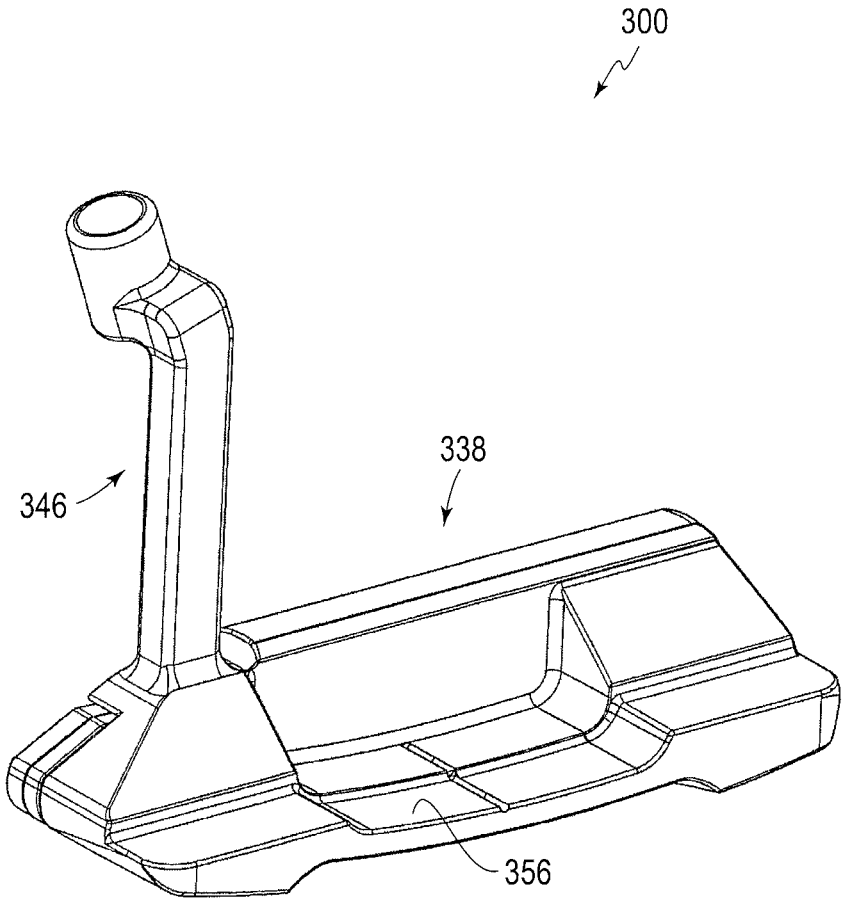
FIG. 23 is a rear perspective view of the golf club head of FIG. 16.

Accordingly, the rear portion 332 of the putter head 300 preferably includes at least one beveled surface 354. Preferably a bevel 354 is located on the bottom (sole) surface 334 proximate, and adjacent, the rearward surface 342. However, in some such embodiments, a second beveled surface is located on the top surface 336, in addition, proximate the rearward surface 342. Alternatively, and as shown in FIG. 23, the top surface 336 of the rear portion 332 includes a central channel 356 extending in the front-to-rear direction. In either case, the rear portion 332 preferable tapers (e.g. by way of the bevel 354) from a first thickness no less than 5 mm to a second thickness that is less than the first thickness. More preferably, the first thickness is between 5 mm and 10 mm, even more preferably between 5 mm and 8 mm. Also, preferably, the second thickness is no greater than 6 mm, more preferably no greater than 5 mm, and even more preferably within the range of 3 mm to 5 mm. These parameters are preferably satisfied at least in a central vertical cross-section passing through the geometric center 352 of the striking face 324 and perpendicular to the general plane of the striking face 324. By structuring the rear portion 332 in this manner, the putter head 300 may satisfy desired mass distribution thresholds (provided a face component as described above), while maintaining attributes associated with and sought in connection with a blade-type putter.

Figure 24:
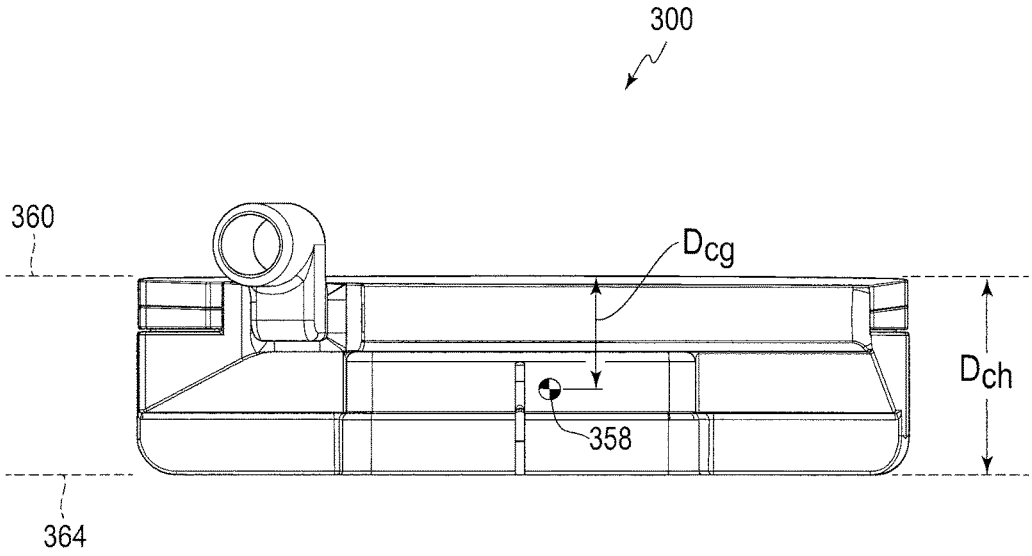
FIG. 24 is a top plan view of the golf club head of FIG. 16.

In some embodiments, as shown in FIG. 24, the putter head 300 include a club head center of gravity 358. The club head is shown in the soled position. A first vertical plane 360 is passes through the forwardmost point of the striking face of the club head and extends in the heel-to-toe direction. The depth of the center of gravity (Dcg) is measured in the forward-to-rearward direction and in a lateral plane (parallel to the ground plane, which coincides with the plane of the paper in FIG. 24), as the shortest distance between the first vertical plane 360 and the center of gravity 358. Preferably, Dcg is no less than 12 mm, more preferably within the range of 12 mm to 18 mm. The club head 300 also has an overall depth (Dch) measured as the lateral distance between the first vertical plane 360 and a second vertical plane 364 that is parallel to the first vertical plane and passes through a rearwardmost point of the club head 300. Dch is preferably no greater than 45 mm, more preferably within the range of 20 mm to 40 mm, and even more preferably between 25 mm and 35 mm. Preferably, the ratio of Dcg to Dch is no less than 0.42, more preferably between about 0.42 and 0.48. Such parameters may improve forgiveness of the club head on off-centered shots.

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

What is claimed is:

1. A putter-type golf club head that, when oriented in a reference position, comprising:

a main body having a front surface, a rear surface, a top surface, and a bottom surface, the front surface being inclined forwardly in an upward direction at an angle $\phi$ relative to vertical as measured in a front-to-rear direction; and a face component comprising:

a first element secured to the front surface of the main body, the first element formed of a resilient material and having a thickness that gradually increases toward a sole portion, the first element comprising a first element front surface, a first element rear surface opposite the first element front surface, and a first element side surface extending intermediate the first element front surface and the first element rear surface, the first element front surface being inclined rearwardly in the upward direction at an angle $\theta$ relative to vertical as measured in the front-to-rear direction, the angle $\theta$ being between 2° and 6°; and a second element forward of the first element and comprising a rigid material, the second element secured directly to the first element.

2. The putter-type golf club head of claim 1, wherein the angle $\phi$ is 1°.

3. The golf club head of claim 1, wherein the second element is secured only to the first element.

4. The golf club head of claim 1, wherein the second element is secured to the first element with a chemical adhesive.

5. The golf club head of claim 1, wherein the first element side surface further comprises a heel side surface, a toe side surface, a top side surface, and a bottom side surface, wherein at least a portion of at least one of the heel side surface, the toe side surface, and the bottom surface side is visually exposed.

6. The golf club head of claim 1, wherein the second element comprises a substantially constant thickness.

7. The golf club head of claim 1, wherein the first element further comprises a flange extending, from a bottom portion of the first element, rearward of the front surface of the main body, flushly with the bottom surface of the main body.

8. A putter-type golf club head that, when oriented in a reference position, comprising:

a main body having a front surface, a rear surface, a top surface, and a bottom surface; and a face component including:

a first element secured to the front surface of the main body, the first element formed of a resilient material and having a thickness that gradually increases toward a sole portion, the first element comprising a first element front surface, a first element rear surface opposite the first element front surface, and a first element side surface extending intermediate the first element front surface and the first element rear surface; and a second element forward of the first element and comprising a rigid material, the second element secured directly to the first element;

a forwardmost point;

a rearwardmost point;

a center of gravity having a depth Dcg, measured in a front-to-rear direction from the forwardmost point of the club head; and an overall club head depth Dch, measured in the front-to-rear direction from the forwardmost point to the rearwardmost point, such that Dch is no greater than 45 mm and Dcg/Dch is no less than 0.42.

9. The putter-type golf club head of claim 8, wherein Dcg is no less than 12 mm.

10. The putter-type golf club head of claim 9, wherein Dcg is within a range of 12 mm to 18 mm.

11. The putter-type golf club head of claim 8, wherein Dch is within a range of 20 mm to 40 mm.

12. The putter-type golf club head of claim 8, wherein Dcg/Dch is within a range of 0.42 to 0.48.

13. The golf club head of claim 8, wherein the first element front surface is inclined rearwardly in an upward direction at an angle $\theta$ relative to vertical as measured in the front-to-rear direction, the angle $\theta$ being between 2° and 6°.

14. The golf club head of claim 8, wherein the second element is secured only to the first element.

15. The golf club head of claim 8, wherein the second element is secured to the first element with a chemical adhesive.

16. The golf club head of claim 8, wherein the first element side surface further comprises a heel side surface, a toe side surface, a top side surface, and a bottom side surface, wherein at least a portion of at least one of the heel side surface, the toe side surface, and the bottom surface side is visually exposed.

17. The golf club head of claim 8, wherein the second element comprises a substantially constant thickness.

18. The golf club head of claim 8, wherein the first element further comprises a flange extending from a bottom portion of the first element, rearward of the front surface of the main body, and flush with the bottom surface of the main body.

* * * * *